US011104556B2

(12) United States Patent
Sellman et al.

(10) Patent No.: US 11,104,556 B2
(45) Date of Patent: Aug. 31, 2021

(54) WIRELINE ASSEMBLY ENCLOSURE

(71) Applicants: Milton Lee Sellman, Pasadena, TX (US); Erik J. Prejean, Maurice, LA (US)

(72) Inventors: Milton Lee Sellman, Pasadena, TX (US); Erik J. Prejean, Maurice, LA (US)

( * ) Notice: Subject to any disclaimer, the term of this patent is extended or adjusted under 35 U.S.C. 154(b) by 161 days.

(21) Appl. No.: 16/601,739

(22) Filed: Oct. 15, 2019

(65) Prior Publication Data

US 2020/0115200 A1 Apr. 16, 2020

Related U.S. Application Data

(60) Provisional application No. 62/745,553, filed on Oct. 15, 2018.

(51) Int. Cl.

| | |
|---|---|
| ***B65D 1/36*** | (2006.01) |
| ***B66D 1/36*** | (2006.01) |
| ***E21B 19/00*** | (2006.01) |

(52) U.S. Cl.

CPC ..... *B66D 1/36* (2013.01); *E21B 19/008* (2013.01); *B66D 2700/026* (2013.01)

(58) Field of Classification Search

CPC .. B65D 2543/00564; B65D 2251/1058; H02G 3/08; H02G 3/081; H02G 3/086; B66D 1/62; B66D 5/30; B66D 1/505; B66D 1/36; B66D 2700/026; E21B 19/008; E21B 19/02

See application file for complete search history.

(56) References Cited

U.S. PATENT DOCUMENTS

| | | | | |
|---|---|---|---|---|
| 3,666,134 | A * | 5/1972 | Rauch | E05B 65/006 220/324 |
| 4,899,823 | A | 2/1990 | Cobb et al. | |
| 6,142,344 | A * | 11/2000 | Kai | B65D 75/5883 222/105 |
| 6,354,461 | B1 * | 3/2002 | Tenney | E05D 7/1044 16/257 |
| 6,918,508 | B2 * | 7/2005 | Hwang | B65D 43/164 220/826 |
| 6,955,381 | B2 * | 10/2005 | Parker | A45C 13/1084 292/113 |
| 8,342,237 | B1 | 1/2013 | Brewer et al. | |

(Continued)

*Primary Examiner* — Kareen K Thomas

(74) *Attorney, Agent, or Firm* — Boudwin Intellectual Property; Daniel Boudwin

(57) ABSTRACT

A wireline assembly enclosure. The wireline assembly enclosure has a first half and a second half which define an interior compartment. The first and second halves are attached via a hinge and move from an open configuration to a closed configuration. The enclosure also has a plurality of apertures. In various embodiments a stuffing box, lubrication tubing, and other materials pass through the apertures into the interior compartment. A sealing material is disposed partially about a perimeter of the first and second halves such that a seal is formed when the two halves are together in the closed configuration. The sealing material is also disposed about a perimeter of the plurality of apertures. An adjustable bar clamp inside the interior compartment of the enclosure clamps hardware in place. The enclosure is secured around a stuffing box and sheave in order to contain overspray from a wireline.

18 Claims, 5 Drawing Sheets

(56) References Cited

U.S. PATENT DOCUMENTS

| | | | | |
|---|---|---|---|---|
| 9,101,948 | B2 * | 8/2015 | Baron | B05B 11/3045 |
| 9,784,065 | B2 | 10/2017 | Holtby et al. | |
| 2002/0179300 | A1 | 12/2002 | Gay et al. | |
| 2006/0260800 | A1 | 11/2006 | Bertane et al. | |

* cited by examiner

WIRELINE ASSEMBLY ENCLOSURE

CROSS REFERENCE TO RELATED APPLICATIONS

This application claims the benefit of U.S. Provisional Application No. 62/745,553 filed on Oct. 15, 2018. The above identified patent application is herein incorporated by reference in its entirety to provide continuity of disclosure.

BACKGROUND OF THE INVENTION

The present invention relates to wireline assemblies and overspray containment. More particularly, the present invention provides for an enclosure that surrounds parts of a wireline assembly, such as a stuffing box and sheave, in order to contain overspray.

In the oil and gas industry, wells are drilled deep into the ground to capture oil and gas. On occasion, measurement devices and assorted other tools need to be lowered into the well to evaluate the state of the well. One method of lowering such items is by utilization of a cabling system or "wireline". Traditionally, the wireline is strung over a pulley or "sheave" and is lubricated prior to entering the well in order to reduce friction along the line. The wireline is stored and unraveled from a spool on the surface as it is used. As the wireline is withdrawn from the well, it is typically covered with lubricant as well as other materials from the well such as oil. As the wireline passes over the sheave, these materials can spray excessively and come into contact with the surrounding environment including workers' vehicles, clothing, and skin. The resulting splatter is undesirable as it not only leaves a mess, but some lubricants are environmentally hazardous and harmful to workers' skin.

Devices have been disclosed in the known art that relate to wireline assembly and overspray containment. These include devices that have been patented and disclosed in patent application publications. However, the devices in the known art have several drawbacks. Workers often place absorbent pads around the wellhead and surrounding areas in an effort to mitigate potential overflow. However, once the pads are drenched, the workers must take the time to lay down the equipment they are working on and replace the pads. This process is not only time consuming, but also costly. Some devices are focused on the stuffing box and serve to contain any leaks emanating from the stuffing box. These devices do not address the problem of overspray emanating from the sheave. Accordingly, a device that is utilized to contain, capture, and redirect the overspray is desired.

The present invention substantially diverges in design elements from the known art and consequently it is clear that there is a need in the art for an improvement to existing wireline assembly and overspray containment devices. In this regard the present invention substantially fulfills these needs.

SUMMARY OF THE INVENTION

In view of the foregoing disadvantages inherent in the known types of wireline assembly and overspray containment devices now present in the prior art, the present invention provides a wireline assembly enclosure wherein the same can be utilized to contain, capture, and redirect the overspray. The present wireline assembly enclosure comprises a first half and a second half which define an interior compartment. The first and second halves are attached via a hinge and move from an open configuration to a closed configuration. The enclosure also has a plurality of apertures. In various embodiments a stuffing box, lubrication tubing, and other materials pass through the apertures into the interior compartment. A sealing material is disposed partially about a perimeter of the first and second halves such that a seal is formed when the two halves are together in the closed configuration. The sealing material is also disposed about a perimeter of the plurality of apertures. An adjustable bar clamp inside the interior compartment of the enclosure clamps hardware in place. The enclosure is secured around a stuffing box and sheave in order to contain overspray from a wireline.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
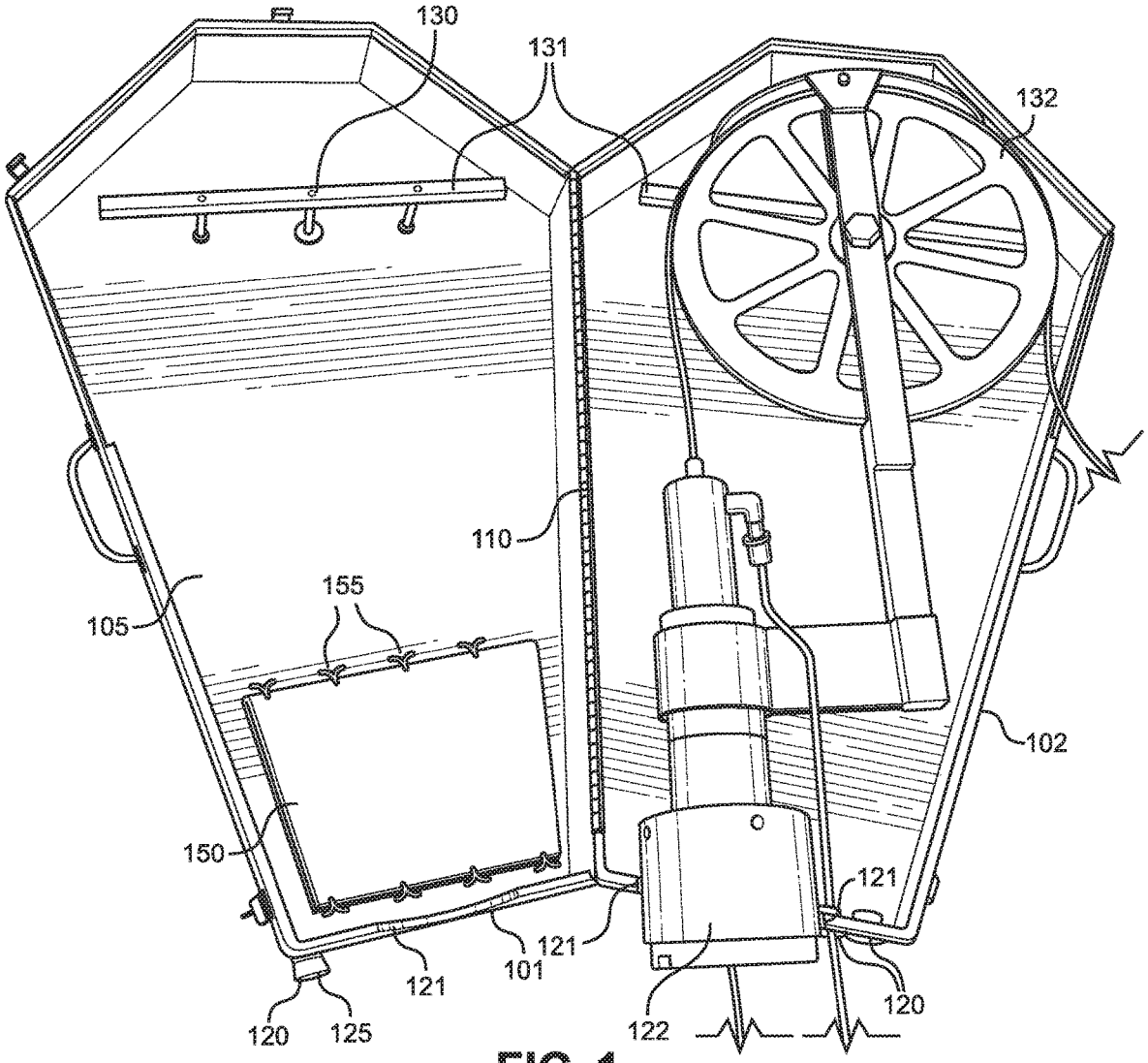
FIG. 1 shows a perspective view of an embodiment of the wireline assembly enclosure in an open configuration.

Reference is made herein to the attached drawings. Like reference numerals are used throughout the drawings to depict like or similar elements of the wireline assembly enclosure. For the purposes of presenting a brief and clear description of the present invention, a preferred embodiment will be discussed as used for the wireline assembly enclosure. The figures are intended for representative purposes only and should not be considered to be limiting in any respect.

Referring now to FIG. 1, there is shown a perspective view of an embodiment of the wireline assembly enclosure in an open configuration. The wireline assembly enclosure comprises a first half 101 and a second half 102. The first half 101 is attached to the second half 102 by a hinge 110 and the two halves are movable via the hinge 110. Through such movement a user is able to selectively achieve a closed configuration of the enclosure, whereby a perimeter of the first half 101 is placed adjacent to a perimeter of the second half 102. In this manner, when the enclosure is in a closed configuration, an interior compartment 105 is defined. In various embodiments, the enclosure is comprised of aluminum, composite, plastic, sheet metal, and metal materials.

In the shown embodiment, the hinge 110 is utilized to achieve an open configuration by rotating the first half 101 away from the second half 102. When the enclosure is in an open configuration, the interior compartment 105 is accessible. The size and shape of the interior compartment 105 is customizable to accommodate and receive various pieces of hardware such as a stuffing box, a pulley, and a sheave. One of ordinary skill in the art will understand that the wireline assembly enclosure is sized and shaped to encapsulate key components of a wireline assembly in order to contain, capture, and redirect overspray that may occur as a wireline is pulled out of a well.

The enclosure further comprises a plurality of apertures 120. In some embodiments, the apertures 120 are wholly integrated into the first half 101, while in other embodiments, the apertures 120 are wholly integrated into the second half 102, or a combination of the first half 101 and the second half 102. In other embodiments, the apertures 120 are defined by corresponding and matching arcuate cutouts in the first half 101 and second half 102 (as further shown in FIG. 3). In still other embodiments, some apertures 120 are wholly integrated into the first half 101 and the second half 102, while other apertures 120 are defined by corresponding and matching arcuate cutouts in the first half 101 and second half 102 (as further shown in FIG. 3). In the shown embodiment, a stuffing box aperture 121 is defined by corresponding and matching arcuate cutouts in the first half 101 and second half 102 in order to receive and fully surround a perimeter of a stuffing box 122.

In the shown embodiment, an aperture 120 further comprises a drain 125. The wireline assembly enclosure, when in a closed configuration, is a liquid-tight enclosure that encapsulates and retains materials, and especially liquids, within the interior compartment 105 as further detailed below. The drain 125 enables a user to selectively remove these materials, such as lubricant or oil, from the wireline assembly enclosure. In various embodiments, the drain 125 incorporates a threading to enable a user to secure a hose or similar complementary threaded device in order to selectively remove the materials from the interior compartment 105.

In one embodiment, a pressure relief mechanism is in communication with the interior compartment 105. In a further embodiment, the pressure relief mechanism is a vent. In another embodiment, a pressure indicator is disposed in the interior compartment 105. The pressure indicator may be a sensor, gauge, tattle tale, or other mechanism which can measure built up materials in the interior compartment, such as gas, liquids, or chemicals. In one embodiment, the pressure indicator in operably connected to the pressure relief mechanism such that when a maximum pressure is achieved inside the interior compartment 105, the pressure relief mechanism is able to vent gas out of the interior compartment 105. In this manner, the enclosure can eliminate built up or stored pressure. In another embodiment, the enclosure is able to be grounded in order to protect against the buildup of static electricity.

An adjustable bar clamp 130 is disposed on the interior compartment 105 of the enclosure. In the shown embodiment, the adjustable bar clamp 130 comprises a pair of bars 131 mounted horizontally at a top portion of each of the first half 101 and the second half 102. The pair of horizontal bars 131 are situated such that when the enclosure is in a closed configuration, the horizontal bars 131 compress a desired structure, such as a sheave 132 between the two horizontal bars 131. In the shown embodiment, the horizontal bars 131 compress against a framework of the sheave 132 such that the sheave 132 is still free to rotate about its axis. A user is able to adjust the distance that each of the horizontal bars 131 reside away from the walls of the first half 101 and the second half 102 in order to customize the fit of the adjustable bar clamp 130 and provide a tight fit against the sheave 132. In this manner, a user is able to secure the sheave 132 within the interior compartment 105 of the enclosure.

In various embodiments, a plurality of absorbent pads 150 are removably securable to the interior compartment 105 of the enclosure. The absorbent pads 150 are configured to absorb and hold on to liquids and other undesirable materials. The absorbent pads 150 provide an extra level of containment of materials from the well. In a further embodiment, a plurality of fasteners 155 are disposed in the interior compartment 105 of the enclosure. The plurality of fasteners 155 are configured to removably secure the plurality of absorbent pads 150. In such a manner, a user is able to secure absorbent pads 150 in the interior compartment 105 and when the absorbent pads 150 become saturated, the user is able to remove the saturated absorbent pads 150 and replace them with new pads. In the shown embodiment, the pads 150 are disposed along a lower portion of the interior compartment 105. In embodiments where a drain 125 is not present, the pads 150 provide a mechanism to absorb the materials from the well such that the materials are not free-flowing and spill out when the enclosure is opened.

Figure 2:
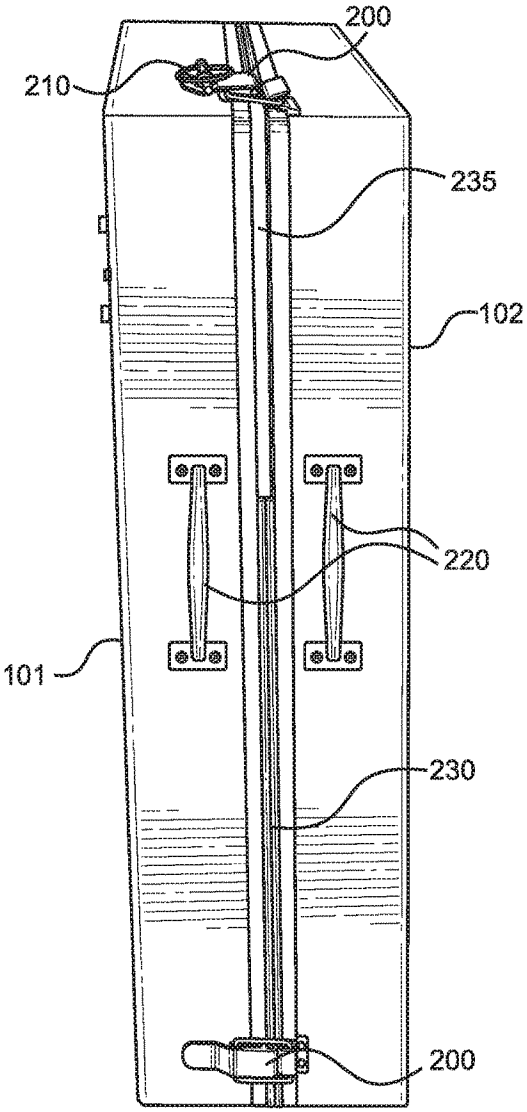
FIG. 2 shows a side view of an embodiment of the wireline assembly enclosure in a closed configuration.

Referring now to FIG. 2, there is shown a side view of an embodiment of the wireline assembly enclosure in a closed configuration. A plurality of latches 200 is disposed partially about a perimeter of the enclosure. The latches 200 selectively maintain the enclosure in a closed configuration. In the shown embodiment, the latches 200 comprise complementary hooks and fasteners, disposed on the edges of the first half 101 and second half 102 such that when the latches 200 are closed, the first half 101 and the second half 102 are securely held in the closed configuration. In one embodiment, a locking pin 210 is disposed through the latches 200 to prevent the latches 200 from opening unintentionally.

At least one handle 220 is disposed on an exterior side of the enclosure. In the shown embodiment, a pair of handles 220, one on each the first half 101 and the second half 102 are disposed. The handles 220 provide a way to carry the device in a convenient way. In the shown embodiment, the pair of handles 220 provide a user with a way to open and close the device by grasping each handle and pulling the two halves apart or together.

A sealing material 230 is disposed partially about a perimeter of the first half 101 and partially about a perimeter of the second half 102. In the shown embodiment the sealing material 230 is disposed in such a manner as when the two halves 101, 102 are brought together, a liquid tight seal is formed. The seal keeps liquids and other material within the interior compartment of the enclosure, and in such a manner contains overspray that may occur as a wireline is drawn out of the well. In various embodiments, the sealing material 230 comprises rubber, plastic, and other suitable materials. In some embodiments, the seal that is formed is a water-tight seal. In the shown embodiment, a gap 235 in the sealing material 230 is disposed along a portion of the perimeter of the first half 101 and the second half 102. The gap 235 provides a pathway for a wireline to enter the interior compartment of the enclosure and travel along the sheave to the stuffing box, as seen in FIG. 1, while the enclosure is in a closed configuration. In this manner, the portion of the wireline from the stuffing box to the gap is enclosed by the enclosure while allowing an additional portion of the wireline to be fed to and from the well from a spool on the surface without opening the enclosure. In one embodiment, the enclosure is sized to encapsulate the entire stuffing box.

In other embodiments, the enclosure is sized to fit a grease head, sheaves, and/or suspended sheaves.

Figure 3:
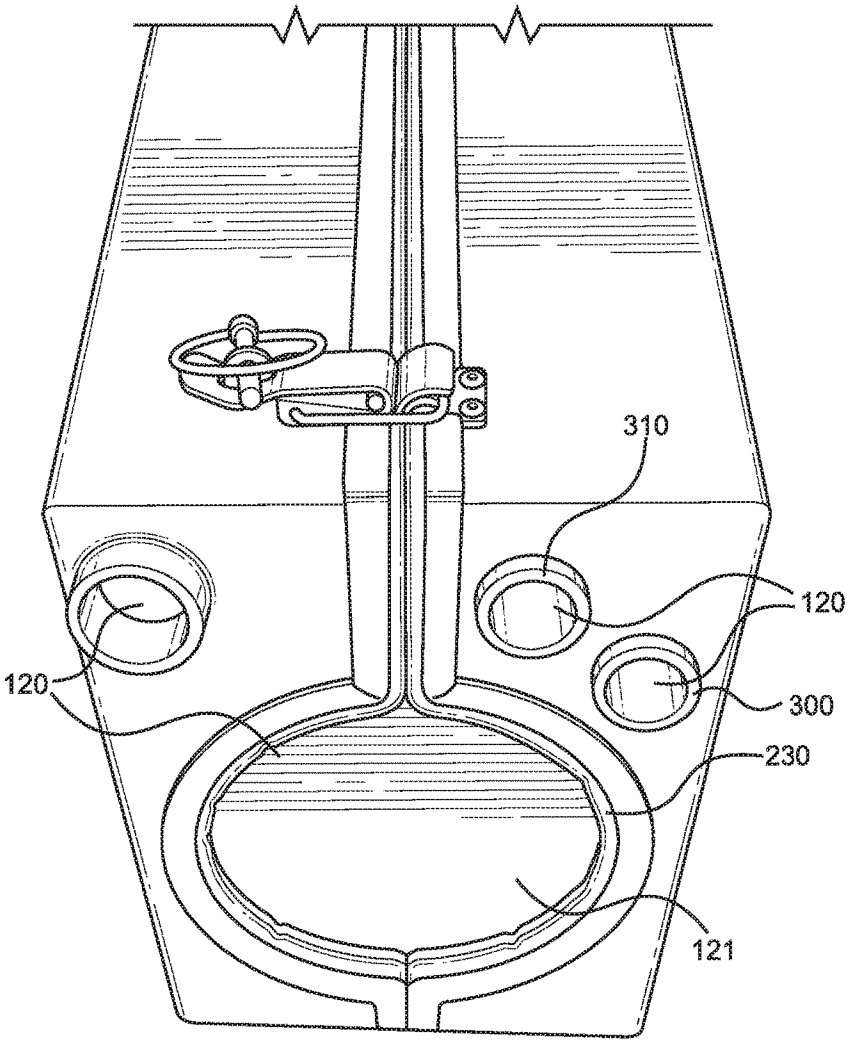
FIG. 3 shows a bottom view of an embodiment of the wireline assembly enclosure in a closed configuration.

Referring now to FIG. 3, there is shown a bottom view of an embodiment of the wireline assembly enclosure in a closed configuration. In various embodiments, the sealing material 230 is disposed about a perimeter of at least one of the plurality of apertures 120. In the shown embodiment, the sealing material 230 is disposed about the perimeter of the stuffing box aperture 121, such that when the stuffing box is encircled by the enclosure, a liquid-proof seal is formed by compression of the sealing material 230 against the stuffing box. In a similar manner, in the shown embodiment the sealing material 230 is disposed about the perimeter of an aperture for a lubrication hose 300 and an aperture for a wireline 310. In this manner, a variety of lines and tubes are able to be fed into the interior compartment of the enclosure while maintaining a closed configuration and a liquid-proof seal such that materials will not escape the interior compartment. In one embodiment, the sealing material 230 is configured to be positioned around, above, or below a union body.

Figure 4:
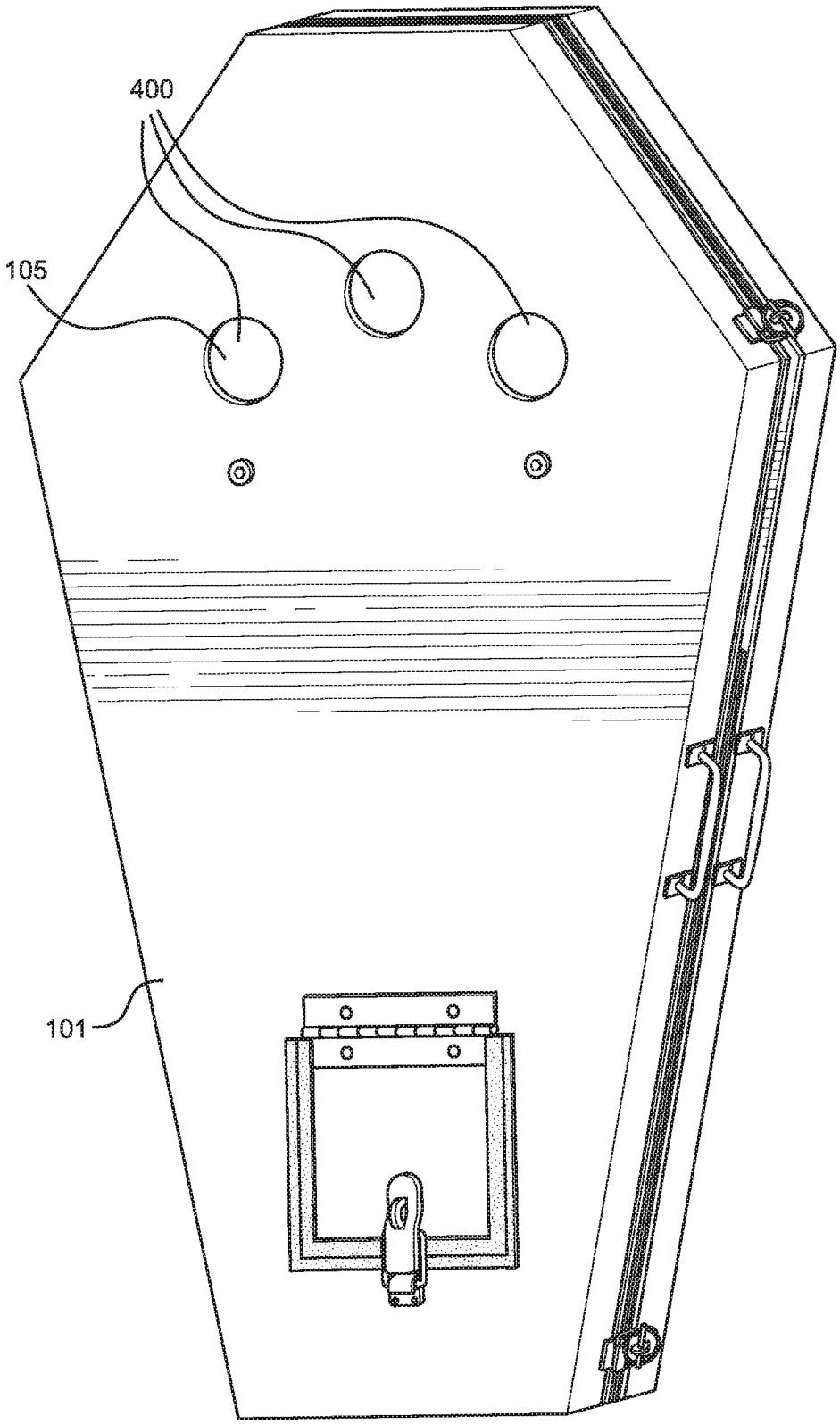
FIG. 4 shows a front view of an embodiment of the wireline assembly enclosure in a closed configuration.

Referring now to FIG. 4, there is shown a front view of an embodiment of the wireline assembly enclosure in a closed configuration. In various embodiments, the wireline assembly enclosure further comprises at least one window 400. In the shown embodiment, the first half 101 of the enclosure includes three windows 400 in the form of circular cutouts. One of ordinary skill in the art would understand that alternate cross-sections of the cutouts, such that the cutouts are able to conform to a desired shape, are contemplated by this disclosure. The windows 400 enable a user to monitor the interior compartment 105 of the enclosure. In this manner, an individual is able to view the sheave and other components encapsulated thereby to ensure that no issues, such as obstructions, arise within the interior compartment 105. In other embodiments, an indicator is disposed that is configured to indicate when the sheave is moving.

Figure 5:
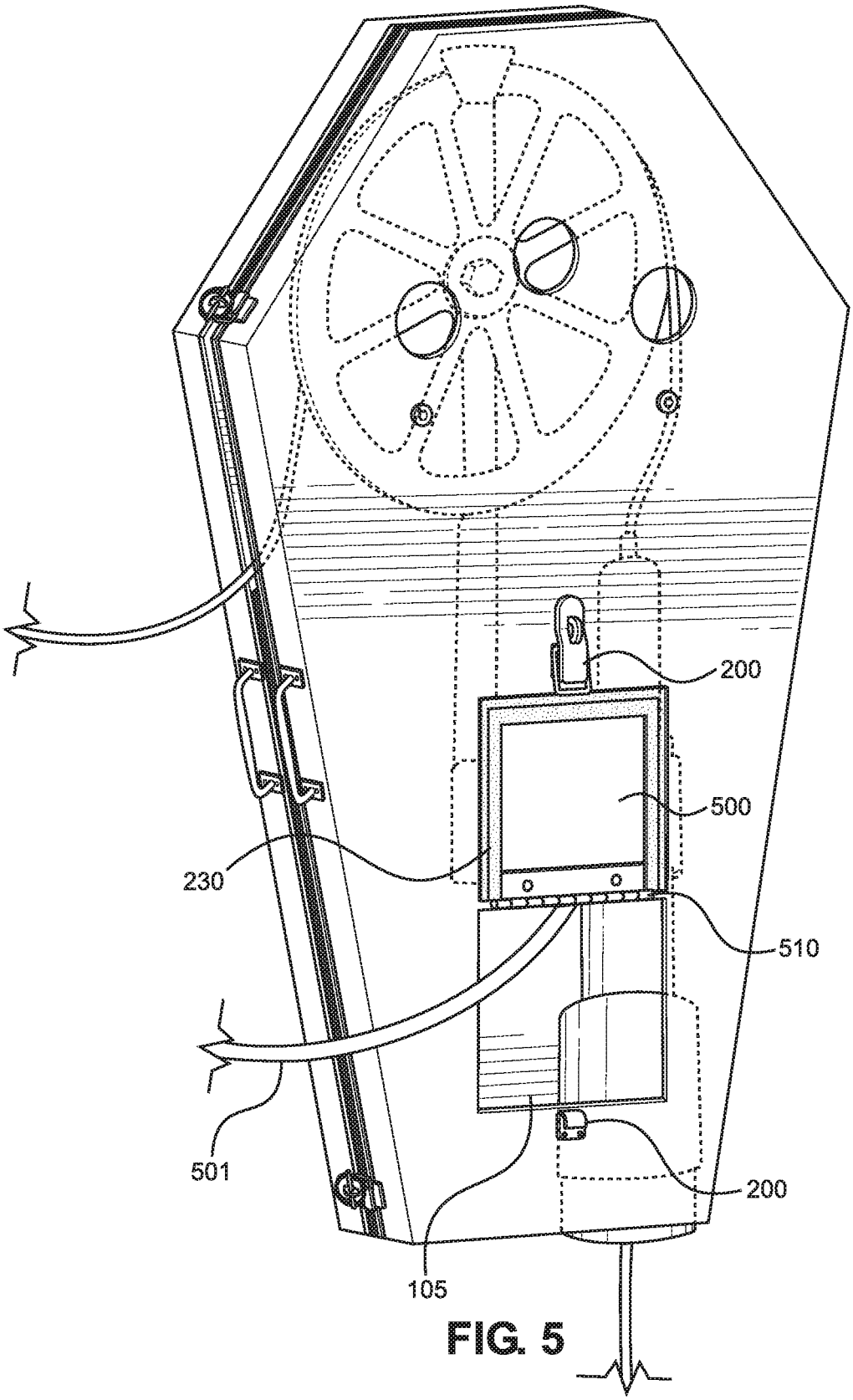
FIG. 5 shows a perspective view of an embodiment of the wireline assembly enclosure, with a focus on an access panel.

Referring now to FIG. 5, there is shown a perspective view of an embodiment of the wireline assembly enclosure, with a focus on an access panel. In various embodiments, at least one access panel 500 is hingedly attached to the enclosure. In the shown embodiment, the access panel 500 is secured to the enclosure by a panel hinge 510 on a top edge. In the shown embodiment, sealing material 230 is disposed on three sides of the hinge in order to form a seal when the access panel 500 rests against the body of the enclosure. In various embodiments, the panel hinge 510 is liquid tight such that materials will not seep out of the enclosure via the panel hinge 510 when the access panel 500 is closed. The access panel 500 is utilized to enable a user to access the interior compartment 105 without opening the enclosure. The access panel 500 is also utilized to pass components, such as a wireline or lubrication tube 501 into the interior compartment 105. Through utilization of the sealing material 230, such components are able to be run through the access panel 500 into the interior compartment 105 and the access panel 500 is able to be closed on top of the components, thereby forming a seal while a portion of the component resides outside of the interior compartment 105. In the shown embodiment, a latch 200 is disposed on the access panel 500 and the enclosure such that a user can selectively secure the access panel 500 against the enclosure in a closed configuration. In various embodiments, multiple access panels 500 are disposed on surfaces of the enclosure to enable a user to access desired portions of the interior compartment 105.

Figure 6:
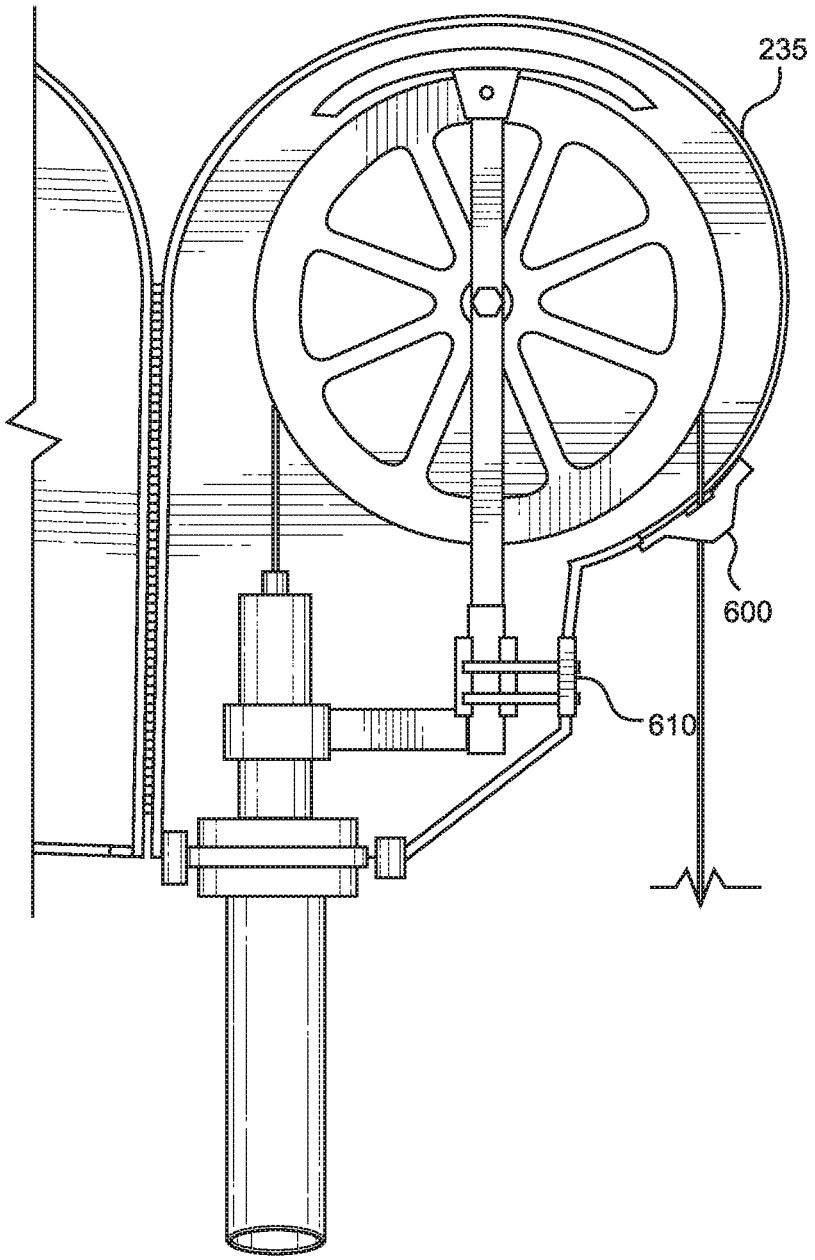
FIG. 6 shows a side view of an embodiment of the wireline assembly enclosure in an open configuration.

Referring now to FIG. 6, there is shown a side view of an embodiment of the wireline assembly enclosure in an open configuration. In the shown embodiment, a cable guide 600 is disposed in the gap 235 of the enclosure. In various embodiments, the cable guide is comprised of Teflon, rubber, composite, or other similar materials that are adapted to surround a cable, but allow free flow of the cable through the guide. The cable guide 600 is selectively adjustable and can be secured in a fixed position or can be adjusted along the gap 235 as needed for cable positioning.

Further, in the shown embodiment, an attachment clamp 610 is disposed in the interior compartment. In various embodiments, the attachment clamp 610 is comprised of Teflon, rubber, composite, metal, aluminum, or other similar materials. The attachment clamp 610 is adjustable in both a vertical and horizontal direction in order to secure various sized fittings. In other embodiments, the attachment clamp 610 comprises multiple attachment clamps 610 and is attached to various locations on the stuffing box.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wireline assembly enclosure, comprising:

an enclosure having a first half and a second half, thereby defining an interior compartment;

the first half hingedly attached to the second half, wherein the first half is moveable from an open configuration to a closed configuration;

the enclosure further comprising a plurality of apertures;

a sealing material disposed partially about a perimeter of the first half and partially about a perimeter of the second half;

the sealing material disposed about a perimeter of at least one of the plurality of apertures;

an adjustable bar clamp disposed on the interior compartment of the enclosure.

2. The wireline assembly enclosure of claim 1, further comprising a plurality of latches disposed partially about a perimeter of the enclosure which maintain the enclosure in a closed configuration.

3. The wireline assembly enclosure of claim 1, further comprising a plurality of absorbent pads removably securable to the interior compartment of the enclosure.

4. The wireline assembly enclosure of claim 3, further comprising a plurality of fasteners disposed in the interior compartment of the enclosure which removably secure the plurality of absorbent pads.

5. The wireline assembly enclosure of claim 1, further comprising at least one window.

6. The wireline assembly enclosure of claim 1, further comprising at least one handle disposed on an exterior side of the enclosure.

7. A wireline assembly enclosure, comprising:

an enclosure having a first half and a second half, thereby defining an interior compartment;

the first half hingedly attached to the second half, wherein the first half is moveable from an open configuration to a closed configuration;

the enclosure further including a plurality of apertures;

a first aperture adapted to encircle a stuffing box;

a second aperture adapted to encircle a lubrication tubing;

a third aperture adapted to encircle a wireline;

a fourth aperture further comprising a drain;

a sealing material disposed partially about a perimeter of the first half and partially about a perimeter of the second half;

the sealing material disposed about a perimeter of the first aperture, a perimeter of the second aperture, and a perimeter of the third aperture;

an adjustable bar clamp disposed on the interior compartment of the enclosure.

8. The wireline assembly enclosure of claim 7, further comprising a plurality of latches disposed partially about a perimeter of the enclosure which maintain the enclosure in a closed configuration.

9. The wireline assembly enclosure of claim 7, further comprising a plurality of absorbent pads removably securable to the interior compartment of the enclosure.

10. The wireline assembly enclosure of claim 9, further comprising a plurality of fasteners disposed in the interior compartment of the enclosure which removably secure the plurality of absorbent pads.

11. The wireline assembly enclosure of claim 7, further comprising at least one window.

12. The wireline assembly enclosure of claim 7, further comprising at least one handle disposed on an exterior side of the enclosure.

13. A wireline assembly enclosure, comprising:

an enclosure having a first half and a second half, thereby defining an interior compartment;

the first half hingedly attached to the second half, wherein the first half is moveable from an open configuration to a closed configuration;

the enclosure further including a first aperture and a second aperture;

the first aperture adapted to encircle a stuffing box;

the second aperture further comprising a drain;

at least one access panel hingedly attached to the enclosure;

a sealing material disposed about a perimeter of the first aperture and partially about a perimeter of the at least one access panel;

an adjustable bar clamp disposed on the interior compartment of the enclosure.

14. The wireline assembly enclosure of claim 13, further comprising a plurality of latches disposed partially about a perimeter of the enclosure, and on an exterior surface of the access panel, which maintain the enclosure in a closed configuration.

15. The wireline assembly enclosure of claim 13, further comprising a plurality of absorbent pads removably securable to the interior compartment of the enclosure.

16. The wireline assembly enclosure of claim 15, further comprising a plurality of fasteners disposed in the interior compartment of the enclosure which removably secure the plurality of absorbent pads.

17. The wireline assembly enclosure of claim 13, further comprising at least one window.

18. The wireline assembly enclosure of claim 13, further comprising at least one handle disposed on an exterior side of the enclosure.

* * * * *